United States Patent [19]

Merlo

[11] Patent Number: 4,528,482

[45] Date of Patent: Jul. 9, 1985

[54] CONTROL OF ENERGY TO FLUORESCENT LIGHTING

[76] Inventor: Joseph C. Merlo, 22 Wyandotte St., Selden, N.Y. 11784

[21] Appl. No.: 516,124

[22] Filed: Jul. 20, 1983

[51] Int. Cl.[3] ..... G05F 1/00; H05B 37/02

[52] U.S. Cl. ..... 315/291; 315/101; 315/287; 315/307; 315/DIG. 4

[58] Field of Search ..... 315/DIG. 4, 307, 287, 315/101, 291

[56] References Cited

U.S. PATENT DOCUMENTS

| | | | |
|---|---|---|---|
| 3,689,827 | 9/1972 | Quinn | 315/308 |
| 3,890,537 | 6/1975 | Park et al. | 315/207 |
| 4,464,606 | 8/1984 | Kane | 315/307 |

*Primary Examiner*—Harold Dixon

*Attorney, Agent, or Firm*—Posnack, Roberts, Cohen & Spiecens

[57] ABSTRACT

A method and apparatus for reducing the energy consumption of fluorescent lighting energized by an alternating voltage source comprising sensing for a particular amplitude of the alternating voltage and upon sensing such voltage amplitude establishing a given time period which is a fraction of a cycle of the alternating voltage. At the end of the given time period actively connecting the alternating voltage source to the fluorescent lighting whereby the lighting is energized for a portion of the cycle, and for a given time interval at the start of operation continuously actively connecting the alternating voltage source to the fluorescent lighting so that the components of the fluorescent lighting can efficiently warm up.

13 Claims, 1 Drawing Figure

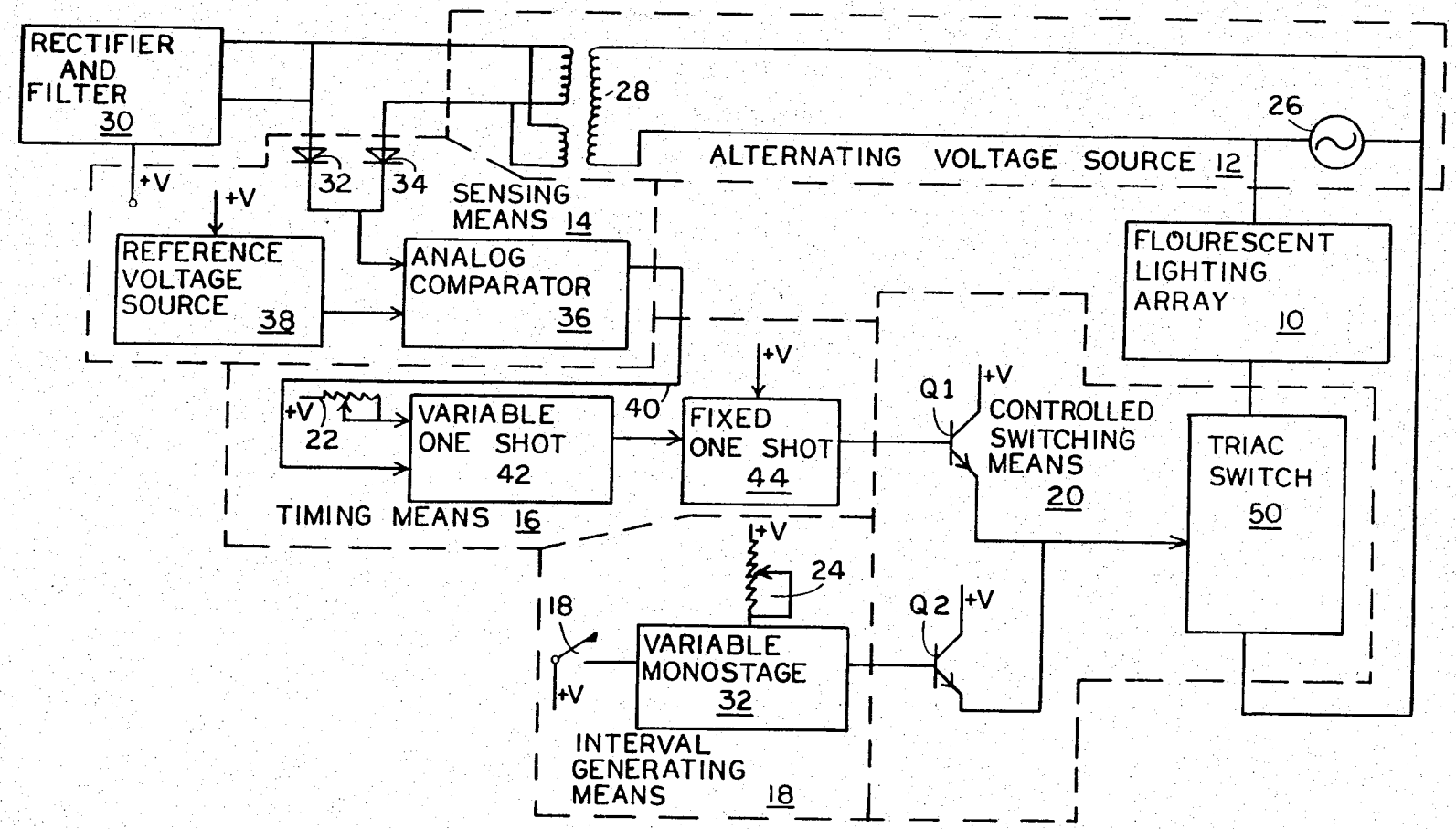
ALTERNATING VOLTAGE SOURCE 12
26
28
FLOURESCENT LIGHTING ARRAY 10
TRIAC SWITCH 50
CONTROLLED SWITCHING MEANS 20
+V
Q1
Q2
FIXED ONE SHOT 44
VARIABLE MONOSTAGE 32
24
INTERVAL GENERATING MEANS 18
18
40
SENSING MEANS 14
ANALOG COMPARATOR 36
VARIABLE ONE SHOT 42
TIMING MEANS 16
22
34
32
REFERENCE VOLTAGE SOURCE 38
RECTIFIER AND FILTER 30

CONTROL OF ENERGY TO FLUORESCENT LIGHTING

BACKGROUND OF THE INVENTION

This invention pertains to energy control and, more particularly, to controllably varying the amount of energy transmitted to fluorescent lighting.

For the last several years, the public has become increasingly conscious of the conservation of energy. This has been brought about in view of the increasing costs for the fundamental sources of energy and, particularly, those related to petroleum. Accordingly, there have been proposed steps to control the artificial lighting within confined areas. When one considers incandescent lighting it is only necessary to use wellknown dimmers which, in effect, decrease the amplitude of the voltage applied to the lamps. However, when fluorescent lighting is considered, one cannot use these conventional amplitude control devices. Furthermore, during the start-up of fluorescent lighting it is necessary to insure that the ballast and other components are suitably warmed as soon as possible to insure efficient operation of the device.

BRIEF SUMMARY OF THE INVENTION

It is, accordingly, a general object of the invention to control the energy flow of fluorescent lighting so that on the one hand there is a net overall saving of consumed energy and, on the other hand, there is rapid and efficient startup of the fluorescent devices.

Briefly, the invention contemplates a method of reducing the energy consumption of fluorescent lighting energized by an alternating voltage source. The method further contemplates sensing for a particular amplitude of the alternating voltage and upon the sensing of such voltage amplitude establishing a given time period which is a fraction of a cycle of the alternating voltage. At the end of this given period, the alternating voltage source is actively connected to the fluorescent lighting whereby the lighting is energized for a portion of that cycle. This will now continue from cycle to cycle; however, for a given time interval at the start of operation the alternating voltage source is continuously actively connected to the fluorescent lighting so that the components of the fluorescent lighting can efficiently warm up.

Other aspects of the invention contemplate apparatus for carrying out this method.

BRIEF SUMMARY OF THE DRAWING

Other objects, the features and advantages of the invention will be apparent from the following detailed description when read with the accompanying drawing, whose sole FIGURE shows by way of example and not limitation the presently preferred embodiments of the invention.

DETAILED DESCRIPTION OF THE PREFERRED EMBODIMENT OF THE INVENTION

In the sole FIGURE, there is shown a power control fluorescent lighting system wherein a fluorescent lighting array 10 is activated by the alternating current source 12 under the control of a controller including a sensing means 14, a timing means 16, an interval generating means 18, and a controlled switching means 20. In summary, when a user closes the switch 22 in the interval generating means 18, the controlled switching means directly connects the alternating voltage across the fluorescent array 10. After a given period of time to permit warmup of the elements in the fluorescent lighting array 10, the remainder of the controller takes hold. Most particularly, the sensing means senses effectively the zero crossings of the alternating voltage in its periodic cycles and emits a signal for each zero crossing to trigger the timing means 16. After a given time delay which is a fraction of the alternating voltage cycle, the timing means 16 energizes the control switching means to connect the alternating voltage directly across the fluorescent lighting array for the remainder of the cycle. By virtue of variable resistor 22 the actual active portion of the cycle can be controlled. Thus, it is possible within reasonable limits to control the energy flow to the lighting array. Similarly, by varying the resistance in the variable resistor 24 one can control the time interval of warmup at the start of operation.

Each of the elements will now be described in greater detail. The alternating voltage source 12 includes the mains 26 to which is connected the primary winding of the transformer 28. Connected to the secondary windings of the transformer 28 are the rectifier and filter array 30 which provide the operating voltage for the remainder of the system. In addition, coupled to the secondary windings of the transformer are the diodes 32 and 34. These diodes are connected in such a way that a full wave rectified AC signal is fed to one input of the analog comparator 36. To the other input of the comparator 36 is connected a reference voltage source 38. The reference voltage is ideally fixed at a value fairly close to ground voltage so that as the half-cycles of the alternating voltage start increasing, the analog comparator emits a signal on line 40 to the trigger input of variable one-shot 42. The variable one-shot 42 is a conventional monostable multivibrator having a resistor in its timing circuit. This is resistor 22. This resistor can be a manually controlled resistor whereby an operator can decide on the point in the alternating voltage cycle where the fluorescents receive voltage or can also be a light-sensitive resistor or the like which controls the amount of dimming of the fluorescent as a function of the ambient light in the region. In any event, the trailing edge of the signal from the variable one-shot 42 is fed to the triggering input of the fixed one-shot 44. The fixed one-shot 44 is used primarily to provide a well-defined uniform width pulse to the controlled switching means 20. The controlled switching means 20 includes the transistor Q1 and a similar transistor Q2. The transistors are, in a sense, connected in parallel, i.e., the collector terminals of the transistors are connected to the operating voltage Plus B whereas their emitter terminals are connected in parallel to the input of a triac switch 50. The base terminal of the transistor Q1 receives a signal from the fixed one-shot 44 and the base electrode of the transistor Q2 receives a signal from the variable monostable 52. The triac switch 50 is a conventional triac having one terminal connected to the fluorescent lighting array 10 and the other terminal connected to one terminal of the alternating voltage source 12. Thus, whenever a pulse is present from the fixed one-shot 44, the transistor Q1 is turned on energizing the triac switch 50 causing the alternating voltage to be applied across the lighting array 10.

The interval generator 18 is also a variable monostable multivibrator which is initially triggered at the start of operation by the depression of the switch 18. The duration of the time interval is controlled by variable resistor 24 which can be manually variable giving an operator the option of determining the time of warmup. It is also possible for this resistor to be a temperature sensitive resistor which increases in resistance with decreasing temperature so that as the ambient temperature is colder the warmup period is longer. In any event, at the start of the warmup period the transistor Q2 is turned on so that the controlling via the transistor Q1 is over-ridden. Accordingly, the full cycles of alternating voltage are applied to the fluorescent lighting array 10.

Although only one apparatus embodiment of the invention has been shown and described in detail, there will now be obvious to those skilled in the art many modifications and variations satisfying many or all of the objects of the invention without departing from the spirit thereof.

What is claimed is:

1. The method of reducing the energy consumption of fluorescent lighting energized by an alternating voltage source comprising sensing for a particular amplitude of the alternating voltage, upon sensing such voltage amplitude establishing a given time period which is a fraction of a cycle of the alternating voltage, at the end of said given time period actively connecting the alternating voltage source to the fluorescent lighting whereby said lighting is energized for a portion of the cycle, and for a given time interval at the start of operation continuously actively connecting the alternating voltage source to the fluorescent lighting so that the components of the fluorescent lighting can efficiently warm up, said given time interval being controllably variable.

2. The method of claim 1 wherein said given time period is controllably variable.

3. Apparatus for reducing the energy consumption of a fluorescent lighting array energized by an alternating voltage source comprising: sensing means for sensing for a particular amplitude of the alternating voltage; timing means connected to said sensing means for generating a control signal a given time period after the sensing of the particular amplitude, said control signal being a fraction of a cycle of alternating voltage; controlled switching means for connecting the fluorescent array to the alternating voltage in response to the control signal; and interval generating means for overriding the control signal for a given time interval at the start of operations for allowing the fluorescent lighting array to operate for full cycles of the alternating voltage whereby efficient warmup of the components of the array is obtained.

4. The apparatus of claim 3 wherein said controlled switching means comprises a triac switch with a control input.

5. The apparatus of claim 3 further comprising first and second transistors having collector terminals connected in parallel to a source of operating voltage, the emitter terminal connected in parallel to the control input of said triac switch, the base terminal of one of said transistors being connected to said timing means and the base terminal of the other of said transistors being connected to said interval generating means.

6. The apparatus of claim 3 wherein the sensing means comprises diode means receiving the alternate voltage, a reference voltage source, and comparator means connected to said diode means and said reference voltage for giving an indication signal whenever the alternating voltage substantially exceeds the reference voltage.

7. The apparatus of claim 3 wherein said timing means comprises a first one-shot means which is operated in response to the receipt of an indication signal for generating a timing signal of controllably variable width, said one-shot means including variable means for varying the width of said timing signal.

8. The apparatus of claim 6 wherein said variable means is a manually variable resistor means.

9. The apparatus of claim 6 wherein said variable means is a light-sensitive variable resistor means.

10. The apparatus of claim 6 wherein said timing means further comprises a second one-shot means which emits a pulse signal of fixed duration in response to the receipt of the termination of said timing signal, said pulse signal being said control signal.

11. The apparatus of claim 3 wherein said interval generating means comprises monostable means which emits an override signal of controllable variable duration, said monostable means including variable means for varying the duration of the override signal.

12. The apparatus of claim 11 wherein said variable means is a manually variable resistor means.

13. The apparatus of claim 11 wherein said variable means is a temperature sensitive variable resistor means.

* * * * *